US011173504B2

(12) United States Patent
Chen

(10) Patent No.: US 11,173,504 B2
(45) Date of Patent: Nov. 16, 2021

(54) DRIVING STRUCTURE OF A GARDEN SPRINKLER

(71) Applicant: SHIN TAI SPURT WATER OF THE GARDEN TOOLS CO., LTD., Chang-Hua Hisen (TW)

(72) Inventor: Chin-Yuan Chen, Lu-Kang Town (TW)

(73) Assignee: SHIN TAI SPURT WATER OF THE GARDEN TOOLS CO., LTD., Chang-Hua Hsien (TW)

( * ) Notice: Subject to any disclaimer, the term of this patent is extended or adjusted under 35 U.S.C. 154(b) by 203 days.

(21) Appl. No.: 16/658,886

(22) Filed: Oct. 21, 2019

(65) Prior Publication Data

US 2021/0114046 A1 Apr. 22, 2021

(51) Int. Cl.

| | |
|---|---|
| ***B05B 3/02*** | (2006.01) |
| ***B05B 3/04*** | (2006.01) |
| *B05B 1/16* | (2006.01) |
| *B05B 15/652* | (2018.01) |

(52) U.S. Cl.

CPC ..... *B05B 3/021* (2013.01); *B05B 3/0409* (2013.01); *B05B 1/1672* (2013.01); *B05B 3/044* (2013.01); *B05B 15/652* (2018.02)

(58) Field of Classification Search

CPC ..... B05B 1/1672; B05B 3/16; B05B 3/021; B05B 3/0409; B05B 3/044; B05B 15/652

See application file for complete search history.

(56) References Cited

U.S. PATENT DOCUMENTS

| | | | | |
|---|---|---|---|---|
| 613,535 | A | 11/1898 | Toles | |
| 3,498,543 | A * | 3/1970 | Gilmour | B05B 3/044 239/242 |
| 5,350,115 | A * | 9/1994 | Burnworth | B05B 3/044 239/242 |
| 6,736,340 | B1 * | 5/2004 | Wang | A62C 2/08 239/242 |
| 7,258,286 | B1 * | 8/2007 | Wang | A62C 2/08 239/240 |
| 7,389,950 | B2 * | 6/2008 | Lo | B05B 3/044 239/201 |
| 2007/0221756 | A1 * | 9/2007 | Wang | B05B 3/044 239/390 |
| 2007/0235568 | A1 * | 10/2007 | Wang | B05B 3/044 239/562 |

(Continued)

*Primary Examiner* — Joseph A Greenlund

(57) ABSTRACT

A driving structure for a garden sprinkler comprising: a main body, a sprinkler unit, at least one adjusting base, and at least one driving member. The main body has a main base and an upper cover corresponding to each other, the main base being hollow and having an assembly opening at an end configured to accept the sprinkler unit and for connection to a hose connector; the main base having a recess and a streaming surface, a plurality of first through apertures disposed on the streaming surface corresponding to a plurality of second through apertures with longer lengths disposed on the upper cover; the recess accepting the adjusting base and forming an enclosure with the upper cover; at least one through hole disposed in a middle portion of the main body and defined by integrating the main base with the upper cover, the through hole provided with a positioning baffle.

10 Claims, 14 Drawing Sheets

(56) References Cited

U.S. PATENT DOCUMENTS

| | | | | |
|---|---|---|---|---|
| 2008/0054103 | A1* | 3/2008 | Nies | B05B 15/652 239/562 |
| 2009/0308950 | A1* | 12/2009 | Lo | B05B 3/044 239/242 |
| 2011/0079662 | A1* | 4/2011 | Wang | B05B 3/044 239/240 |
| 2011/0095101 | A1* | 4/2011 | Wang | B05B 15/652 239/443 |
| 2011/0248102 | A1* | 10/2011 | Wang | B05B 3/00 239/562 |
| 2016/0354792 | A1* | 12/2016 | Su | A01G 25/16 |
| 2018/0178238 | A1* | 6/2018 | Farra | B05B 15/652 |
| 2018/0339302 | A1* | 11/2018 | Cheng | B05B 1/30 |
| 2019/0240681 | A1* | 8/2019 | Cheng | B05B 3/044 |
| 2020/0230627 | A1* | 7/2020 | Chen | B05B 3/16 |
| 2021/0092915 | A1* | 4/2021 | Ye | A01G 25/16 |
| 2021/0114046 | A1* | 4/2021 | Chen | B05B 3/0409 |

* cited by examiner

DRIVING STRUCTURE OF A GARDEN SPRINKLER

BACKGROUND of INVENTION

Field of Invention

The present invention relates to a garden sprinkler, and more particularly to a driving structure of a garden sprinkler capable of providing different sprinkle range.

Description of the Related Art

A conventional spraying device, as shown in FIGS. 9-11, the spraying device 60 has a nozzle device 61 and an adjusting device, and the nozzle device 61 can be connected to a liquid supply source and has a plurality of nozzles 62. The adjusting device is used for adjusting the direction of the nozzle device 61, so that the nozzle 62 can have directional adjustment. The adjusting device further comprises a first guiding member 63 having a plurality of first guiding openings 631 and a second guiding member 64. The second guiding member 64 is capable of moving relative to the first guiding member 63 and has a plurality of second guiding openings 641. With the relative movement of the first guiding member 63 and the second guiding member 64, the first guiding opening 631 and the second guiding opening 641 have different misalignments with each other, and a left and right sliders 65, 66 provided at the two ends of the adjusting device respectively makes the spray direction and the spray density of the nozzle 62 to be adjusted.

However, the conventional structure as described above still has the following problems: In order to adjust the nozzle 62, the first guiding opening 631 and the second guiding opening 641 need to have the appropriate misalignment with each other and the respective operations are executed on the left and right sliders 65, 66, which is quite difficult adjustment and is time consuming and labor intensive. In addition, the spraying device 60 needs separate adjustment at different parts, it might not be able to uniformly spray after the adjustment.

Furthermore, another conventional sprayer, as shown in the FIGS. 12-14, includes: a main body 70 having a tubular shape with a water inlet 702 a plurality of nozzle sleeves 701. The water inlet 702 is disposed at one end of the sprayer, the nozzle sleeves 701 are disposed on a lateral side of the main body 70. The nozzle sleeve 701 are arranged horizontally for a nozzle shaft 711 to be mounted relatively. Two sides of the main body 70 are provided with corresponding ribs 703 for engaging with a lip 732 of a nozzle cover 73. A nozzle driving device comprises a plurality of nozzles 71 connected by a strip and a curved adjusting member 72. The curved adjusting member 72 is provided with a plurality of oblique adjusting openings 721, and the adjusting opening 721 are arranged in different directions as a fan-shaped distribution. Therefore, the curved adjusting member 72 can be rotated by the fan-shaped arrangement, and the one-stage adjusting nozzle 71 is gradually arranged into a fan-shaped nozzle, so that the spray water is sprayed in an average fan-shaped spray range. The nozzle cover 73 has a semi-circular shape and a plurality holes 731 arranged on one side of the nozzle cover 73, and the hole 731 is configured for the nozzle 71. Two sides of the bottom sides of the nozzle cover 73 are bent inwardly as a rim 732, and the nozzle cover 73 covers the adjusting member and the nozzle 71 by engaging the rib 703 of the sprayer and the rim 732.

However, the conventional structure as described above still has the following problems: 1. The curved adjustment piece 72 is pivoted by a adjustment ring 722 at one end, so that the force of the curved adjusting member 72 tends to be unilateral, and the nozzle driving device cannot uniformly apply the force to the curved adjusting member 72. 2. When the curved adjustment piece 72 rotates, the nozzle 71 swings along the oblique adjustment opening 721, so between the same two points, the oblique adjustment port 721 certainly produce a longer distance, making the adjustment of the nozzle 71 more difficult, which is relatively incapable of producing a more even and dense water splash.

Therefore, it is desirable to provide a driving structure of a garden sprinkler to mitigate and/or obviate the aforementioned problems.

SUMMARY OF THE INVENTION

An objective of present invention is to provide a driving structure of a garden sprinkler, which is capable of improving the above-mention problems.

In order to achieve the above mentioned objective, a driving structure for a garden sprinkler is disclosed that includes a main body, a sprinkler unit, at least one adjusting base, and at least one driving member. The main body has a main base and an upper cover corresponding to each other, the main base being hollow and having an assembly opening at an end configured to accept the sprinkler unit and for connection to a hose connector. The main base includes a recess and a streaming surface, with a plurality of first through apertures disposed on the streaming surface that correspond to a plurality of second through apertures with longer lengths disposed on the upper cover. The recess accepts the adjusting base and forms an enclosure with the upper cover. At least one through hole is disposed in a middle portion of the main body and defined by integrating the main base with the upper cover, the through hole provided with a positioning baffle.

Other objects, advantages, and novel features of invention will become more apparent from the following detailed description when taken in conjunction with the accompanying drawings.

DETAILED DESCRIPTION OF THE PREFERRED EMBODIMENT

Figure 1:
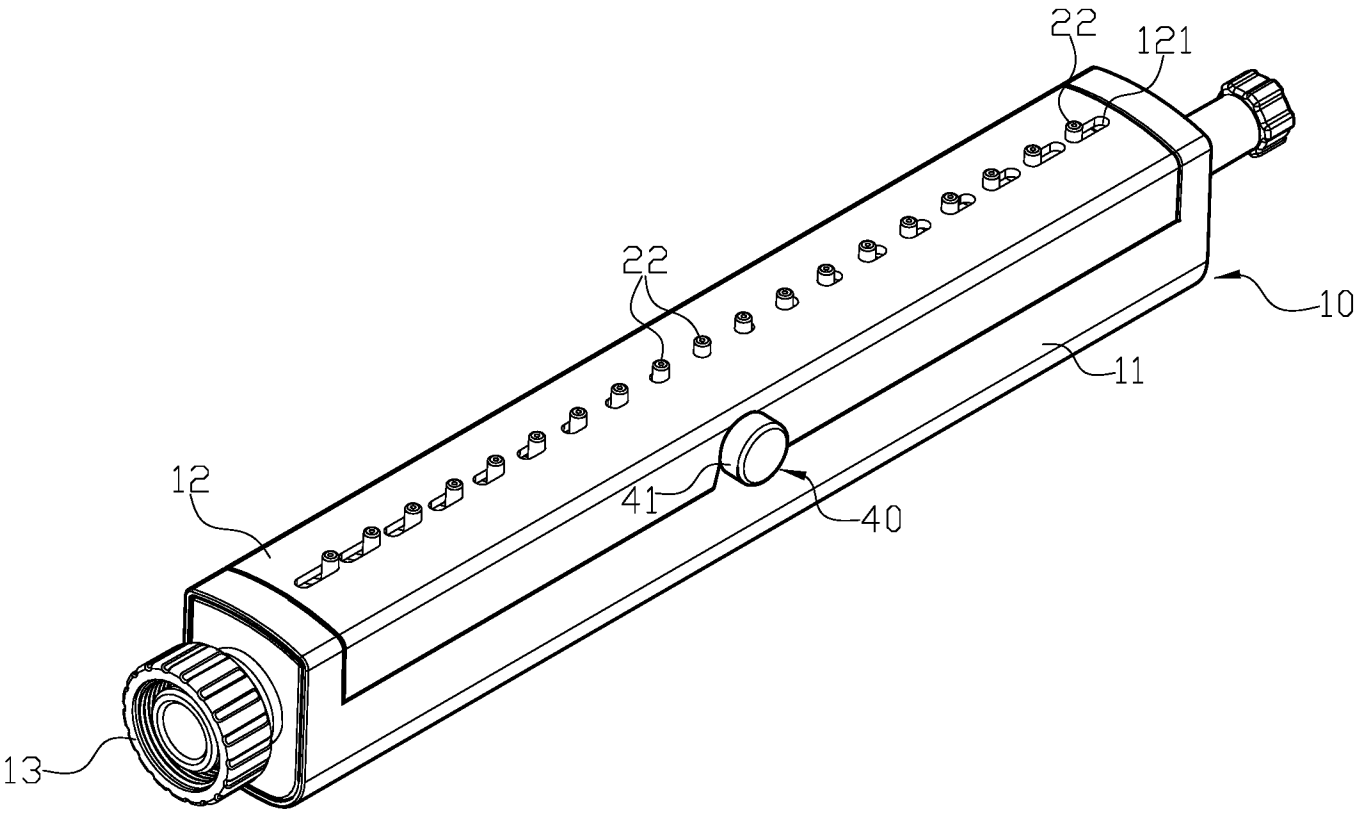
FIG. 1 is a three-dimensional combination of the present invention.
Figure 2:
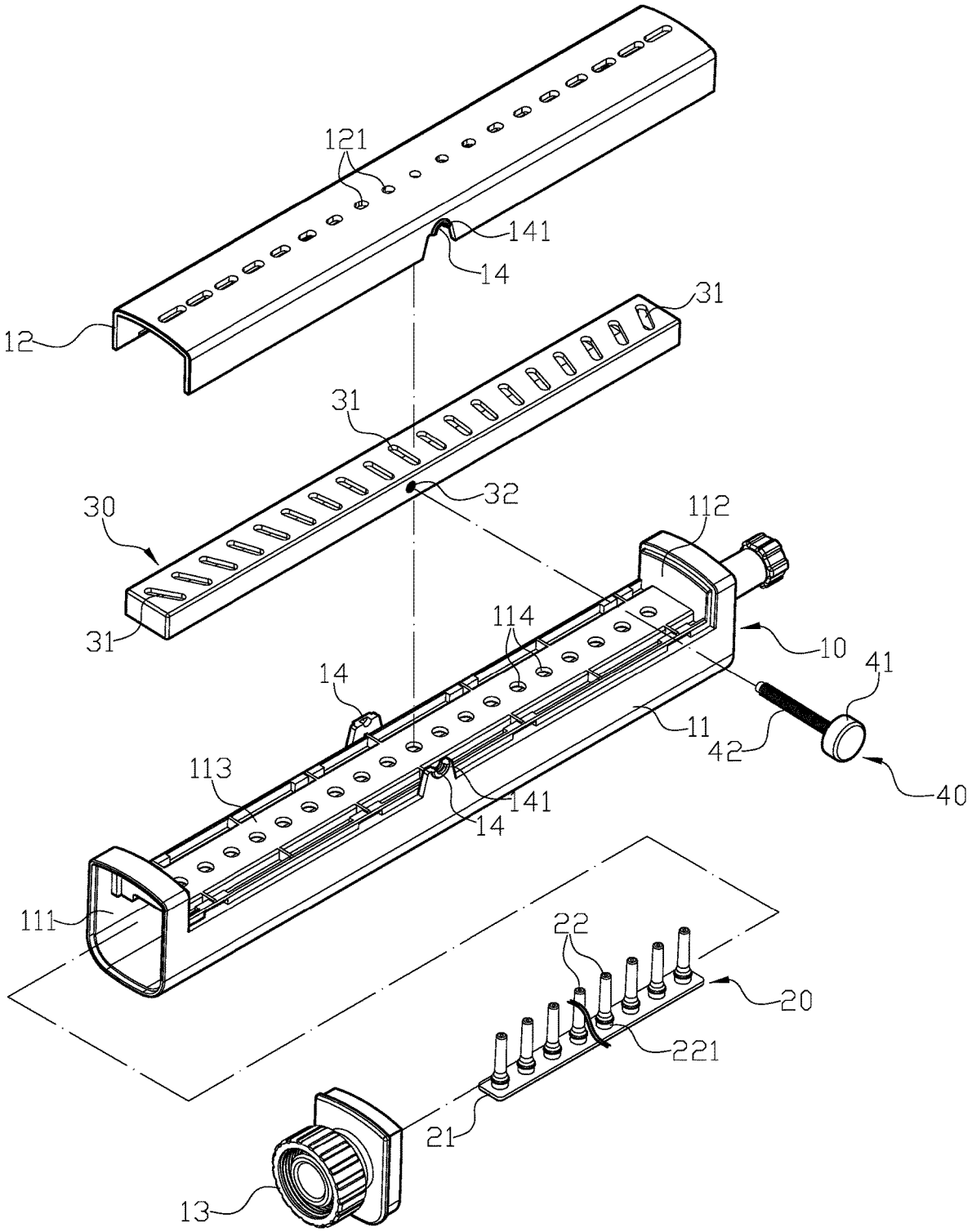
FIG. 2 is an exploded view of the present invention.
Figure 3:
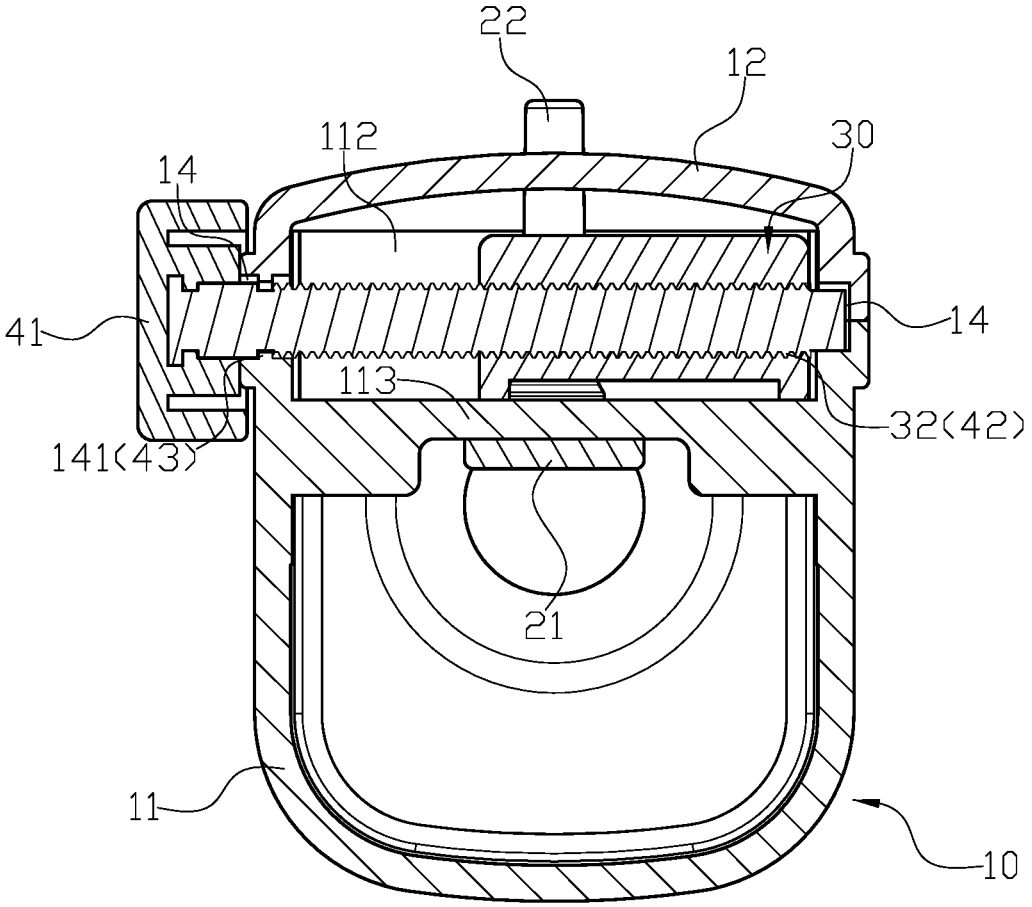
FIG. 3 is a sectional view of the present invention.
Figure 4:
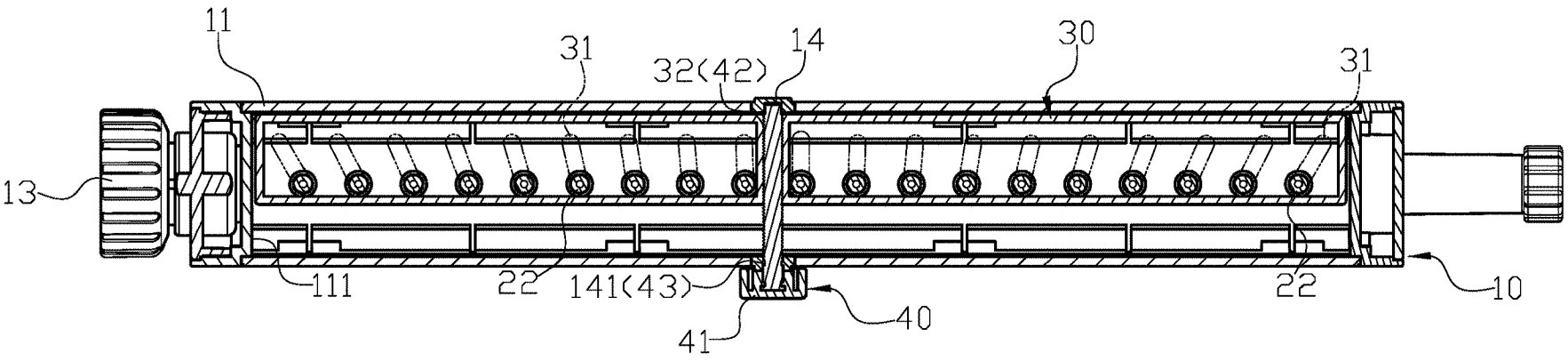
FIG. 4 is another sectional view of another angle of the present invention

First, please refer to FIGS. 1-4. A driving structure for a garden sprinkler comprises: a main body 10, a sprinkler unit 20, at least one adjusting base 30 and at least one driving member 40. The main body 10 has a main base 11 and an upper cover 12 corresponding to each other. The main base 11 is hollow and has an assembly opening 111 at an end configured to accept the sprinkler unit 20 and for connection to a hose connector 13. The main base 11 has a recess 112 and a streaming surface 113, and a plurality of first through apertures 114 disposed on the streaming surface 113 corresponding to a plurality of second through apertures 121 with progressively longer lengths disposed on the upper cover 12. The recess 112 accepts the adjusting base 30 and forming an enclosure with the upper cover 12. Furthermore, the through hole 14 is disposed in a middle portion of the main body 10 and defined by integrating the main base 11 with the upper cover 12, and the through hole 14 is provided with a positioning baffle 141. When the driving member 40 is mounted in the through hole 14 by a screw 42, the positioning baffle 141 causes the driving member 40 to idle on the main body 10 instead of escaping from the main body 10. The sprinkler unit 20 has a plurality of nozzles 22 connected by a connecting strip 21. When the sprinkler unit 20 is disposed in the main base 11 through the assembly opening 111, each nozzle 22 passes through the corresponding first through aperture 114 and the second through aperture 121, and the connecting strip 21 pushes against the streaming surface 113 of the main base 11. The adjusting base 30 has a plurality of adjusting extended holes 31 in a radial arrangement and a screw hole 32 dispose at a middle portion. When the adjusting base 30 is disposed on the recess 112 between the main base 11 and the upper cover 12, the screw hole 32 is aligned with the through hole 14, and each nozzle 22 passes through each corresponding adjusting extended hole 31 and the second through aperture 121 and protrudes from the main body 10. The driving member 40 has a knob 41 comprising a screw 42, and a positioning groove 43 is disposed on the screw 42 adjacent to the knob 41. The driving member 40 is disposed in the through hole 14 and secured by the screw hole 32, and with the combination of the upper cover 12 and the main base 11, the positioning baffle 141 engages the positioning groove 43 to cause the driving member 40 to idle instead of escaping.

In a preferred embodiment, the main base 11 and the upper cover 12 comprise a snap-fit connection.

In the preferred embodiment, the nozzle 22 further comprises an input end passing through the connecting strip 21 and an output end passing through the first through aperture 114, adjusting extended hole 31, the second through aperture 121, and the input end is larger than the output end.

In the preferred embodiment, a neck portion 22 is disposed on the nozzle 22 and adjacent to the connecting strip 21, and the neck portion 22 allows the first through aperture 141 of the main base 11 to engage with the sprinkler unit 20.

In the preferred embodiment, the nozzle 22 is made of rubber or a flexible material.

In the preferred embodiment, the adjusting base 30 is a hollow housing and the assembly opening faces downwardly.

In the preferred embodiment, the main body 10 is configured for direct placement on the ground.

In the preferred embodiment, the main body 10 further comprises a bottom base 50 allowing the main body 10 to rotate on the bottom base 50 while sprinkling water.

In the preferred embodiment, through hole 14 is disposed in a middle portion of the main body 10, and the through hole 14 accepts installation of the adjusting base 30 and a driving member 40, please refer to FIGS. 1-7.

In the preferred embodiment, two adjusting bases 30 are disposed in the recess 112 of the main body 10, the adjusting extended holes 31 on the two adjusting bases 30 are placed in a corresponding radial arrangement and respectively have a screw hole 32 at a middle portion, and each screw hole 32 is provided with a corresponding screw 42 engaging with the driving member 40 of the main body 10.

Figure 5:
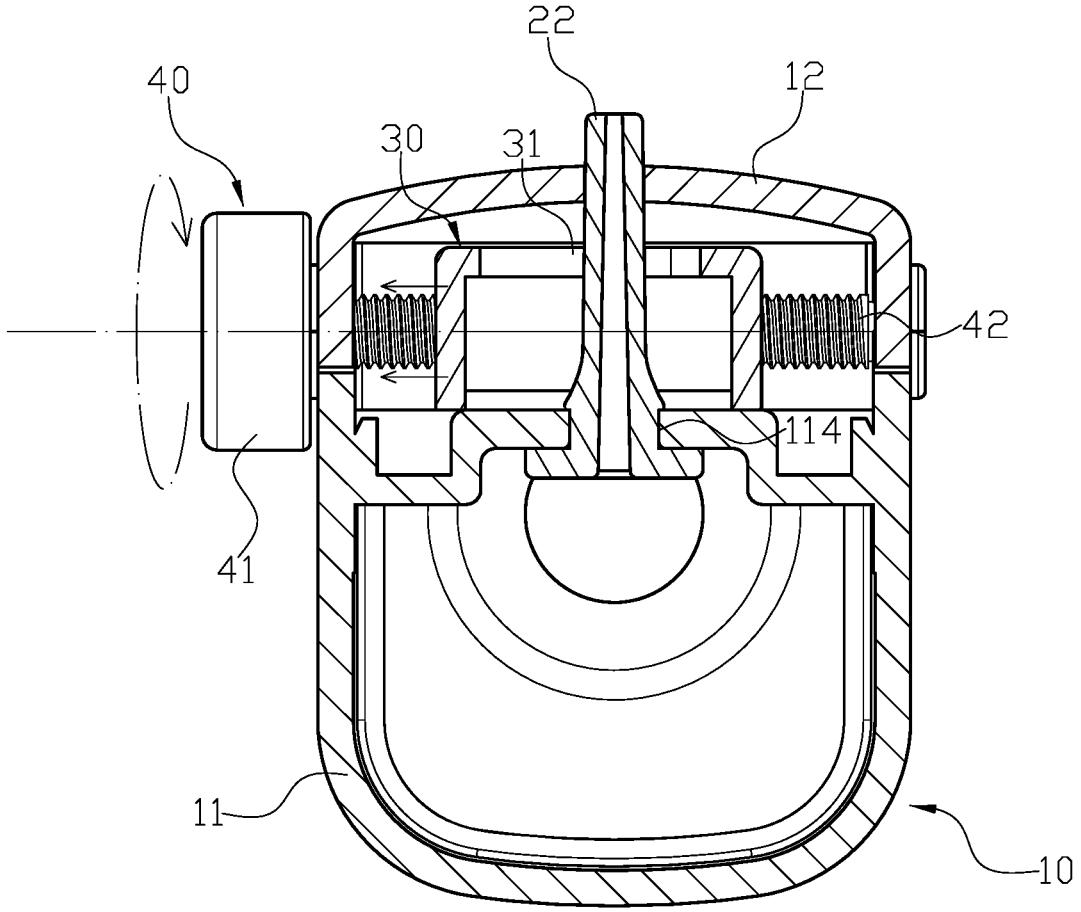
FIG. 5 is a state drawing showing the adjusting base moving after the driving member rotates.
Figure 6:
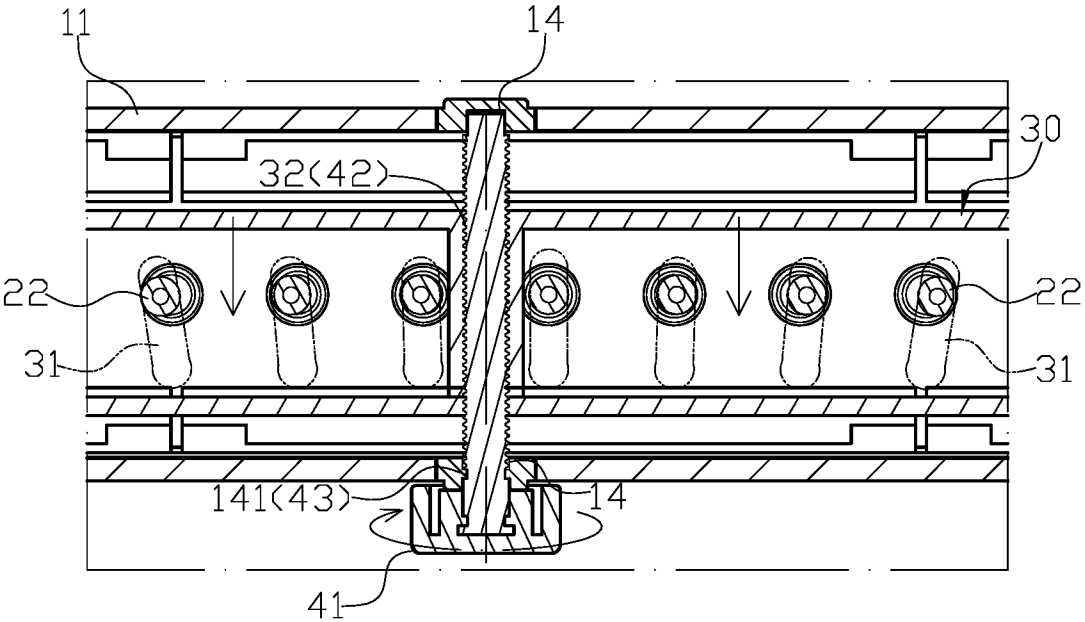
FIG. 6 is a state drawing showing the movement of the adjusting base changes the output angle of the nozzle.
Figure 7:
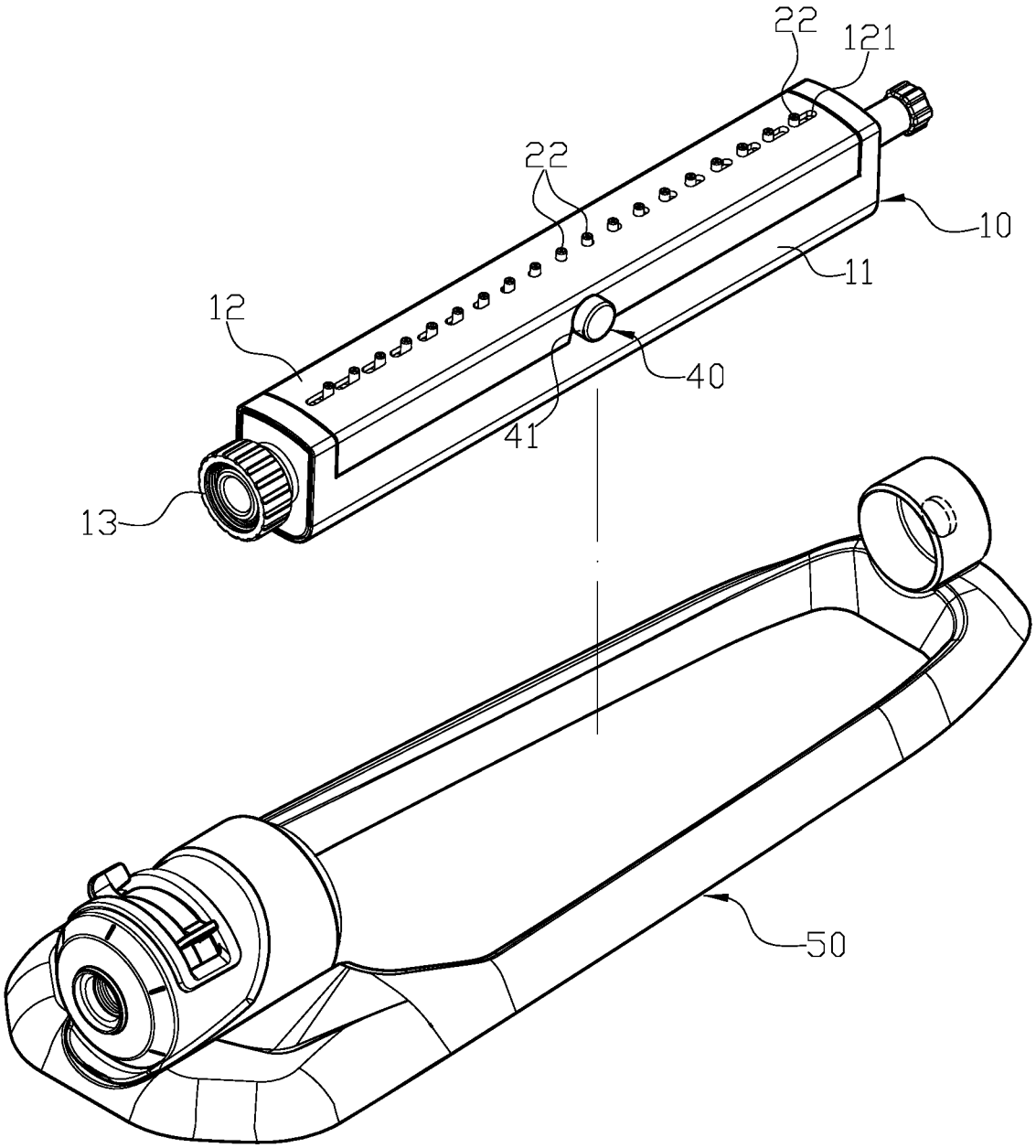
FIG. 7 is a schematic drawing of another preferred embodiment of the present invention.
Figure 8:
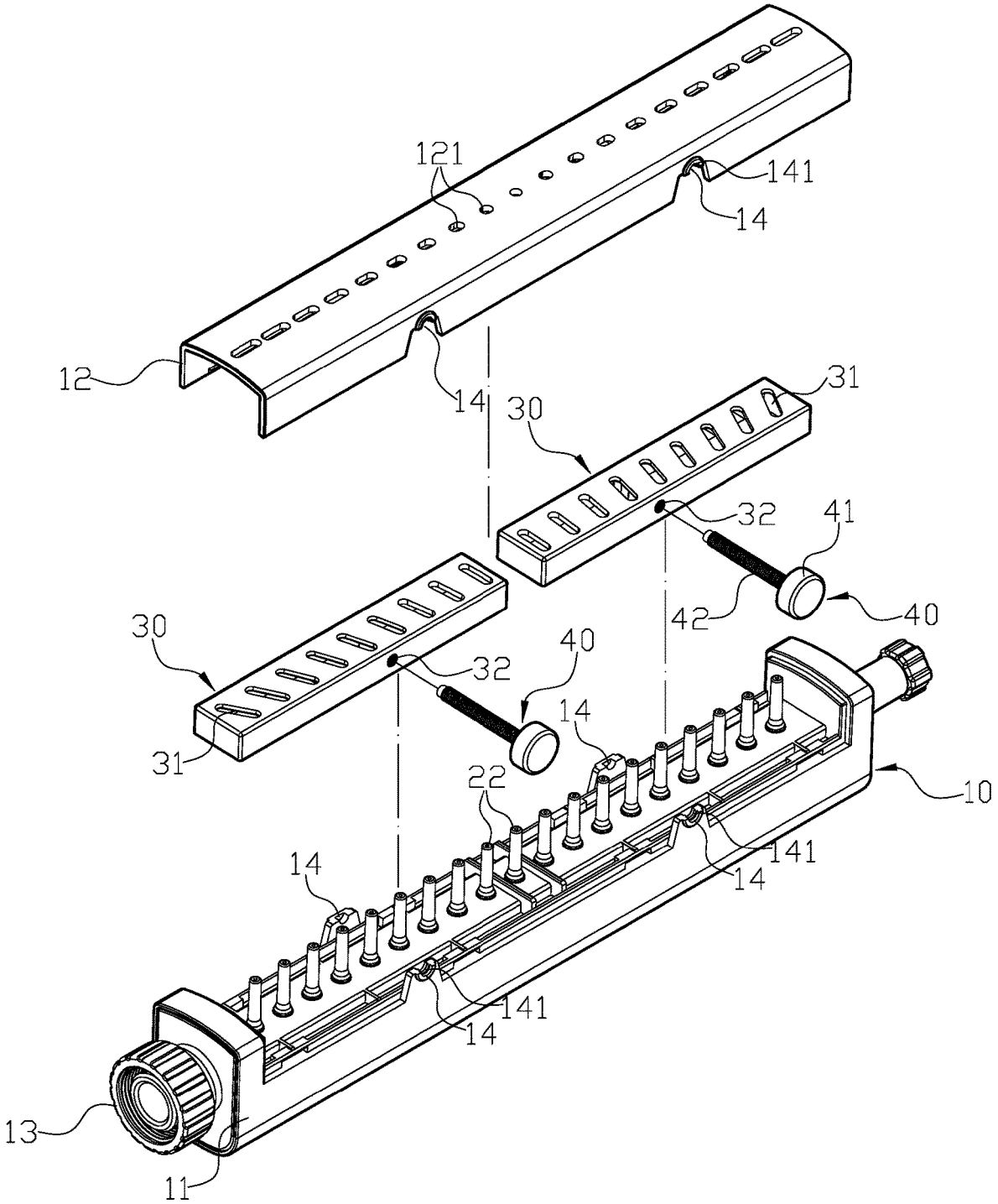
FIG. 8 is another schematic drawing of another preferred embodiment of the present invention.
Figure 9:
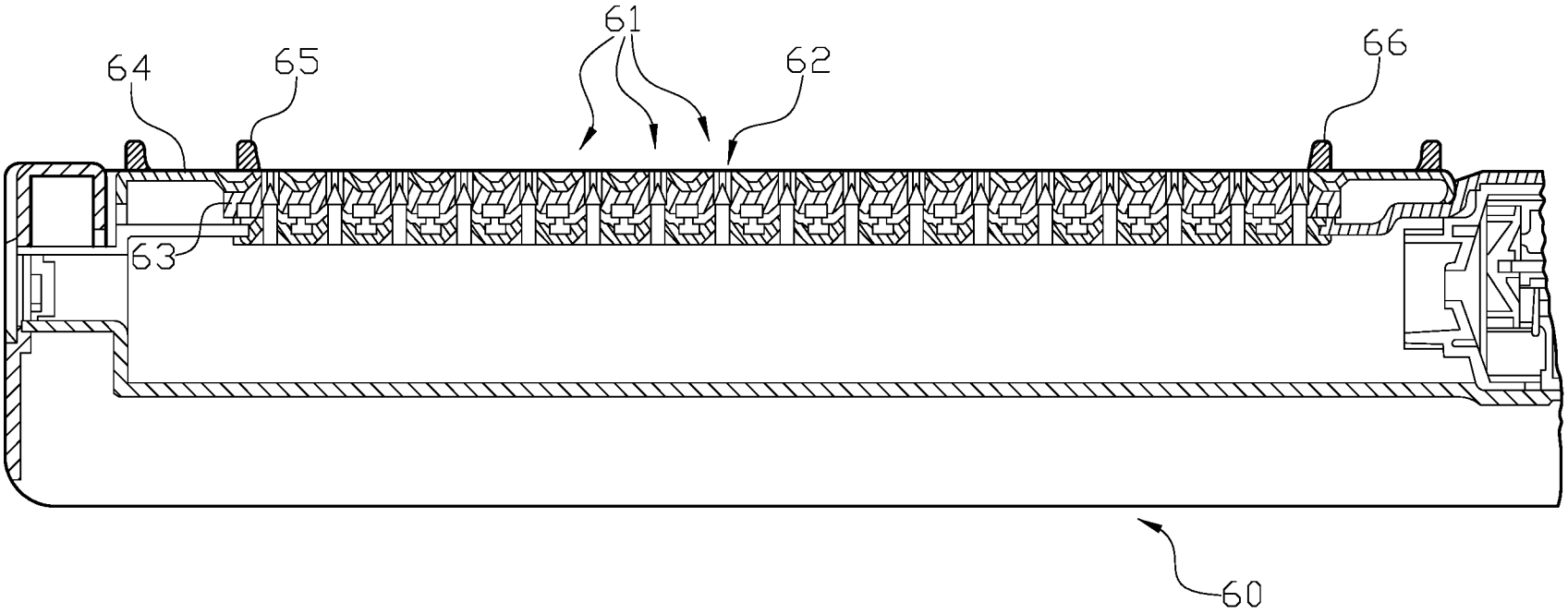
FIG. 9 is a drawing of a conventional structure.
Figure 10:
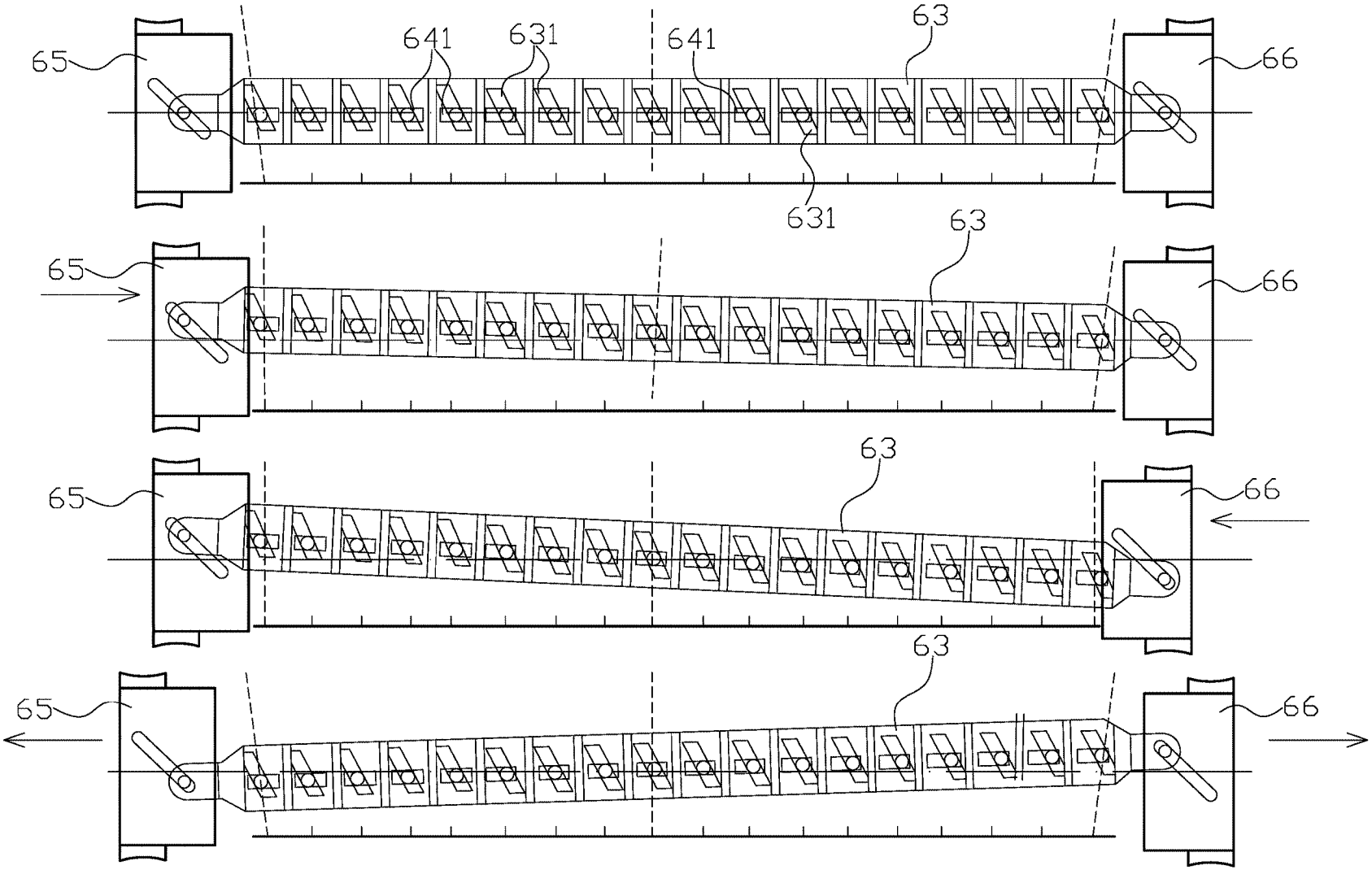
FIG. 10 is drawing showing the adjustment of a conventional structure.
Figure 11:
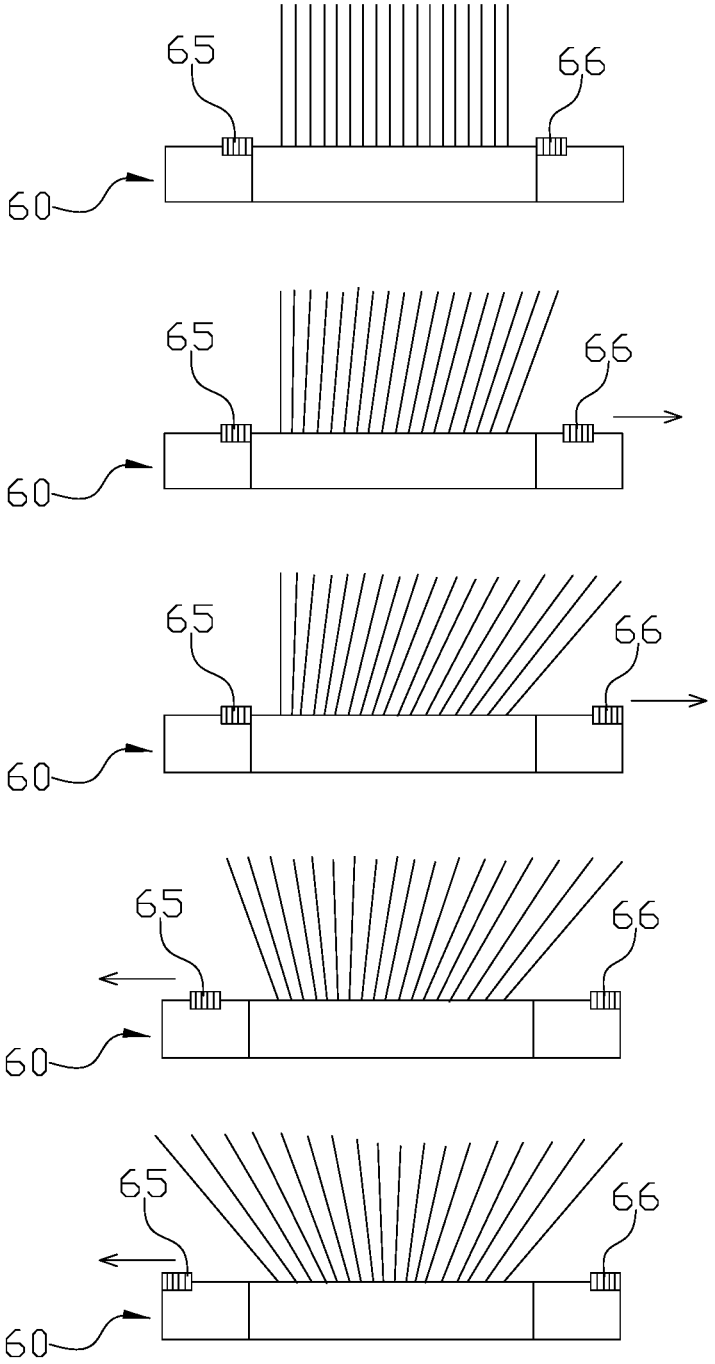
FIG. 11 is a drawing showing a variation of water flow when the conventional structure is adjusted.
Figure 12:
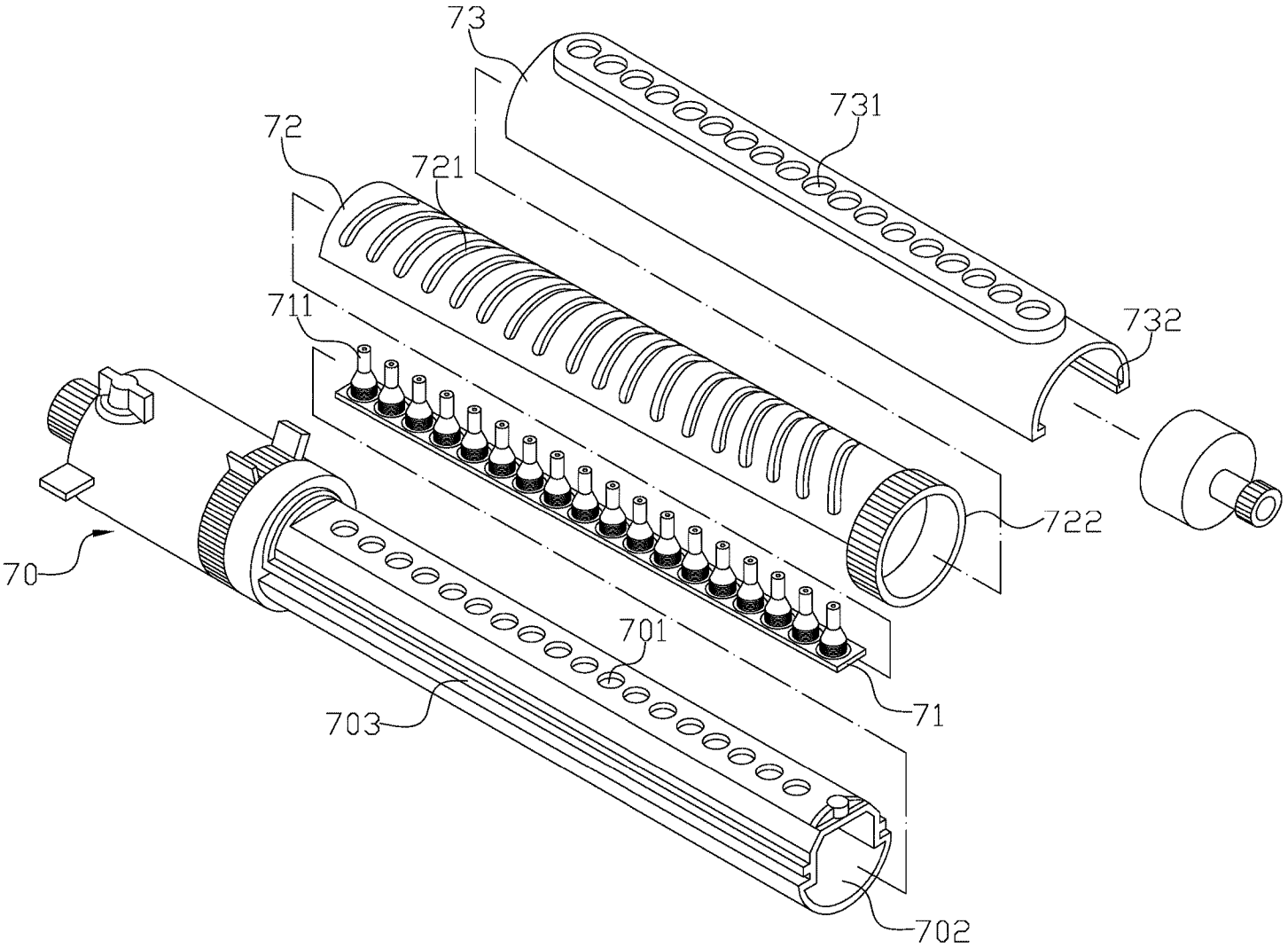
FIG. 12 is a drawing of another conventional structure.
Figure 13:
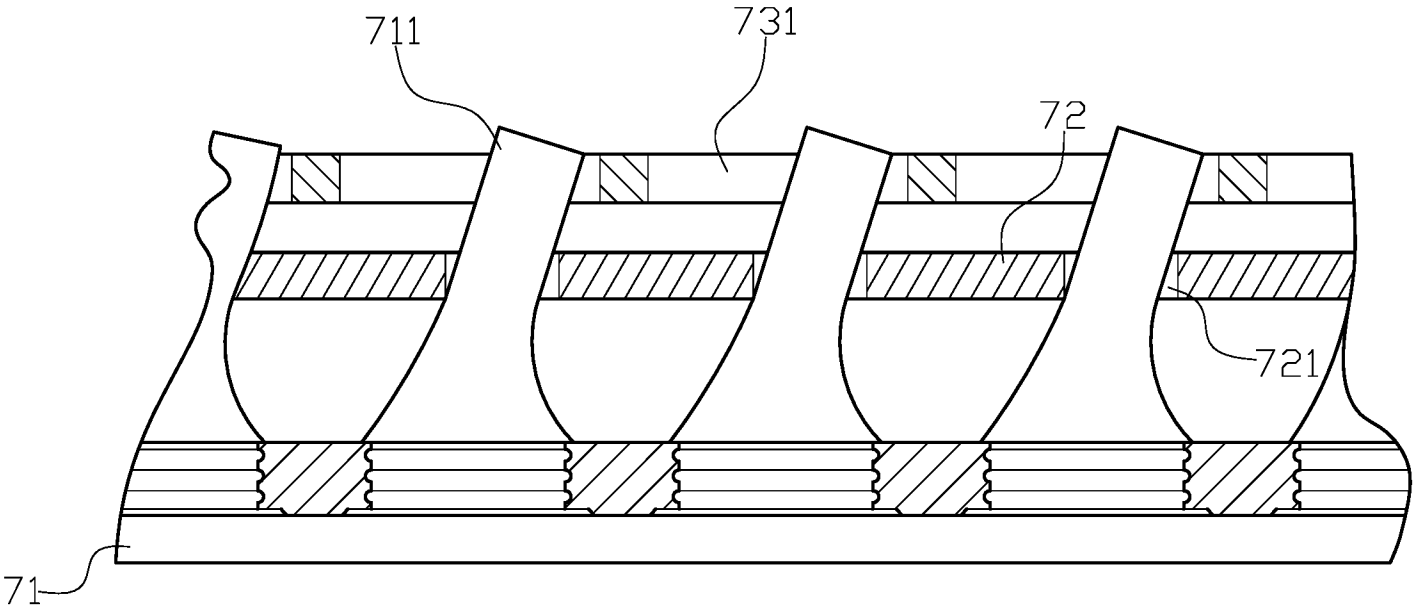
FIG. 13 is a cross-sectional view of another conventional structure.
Figure 14:
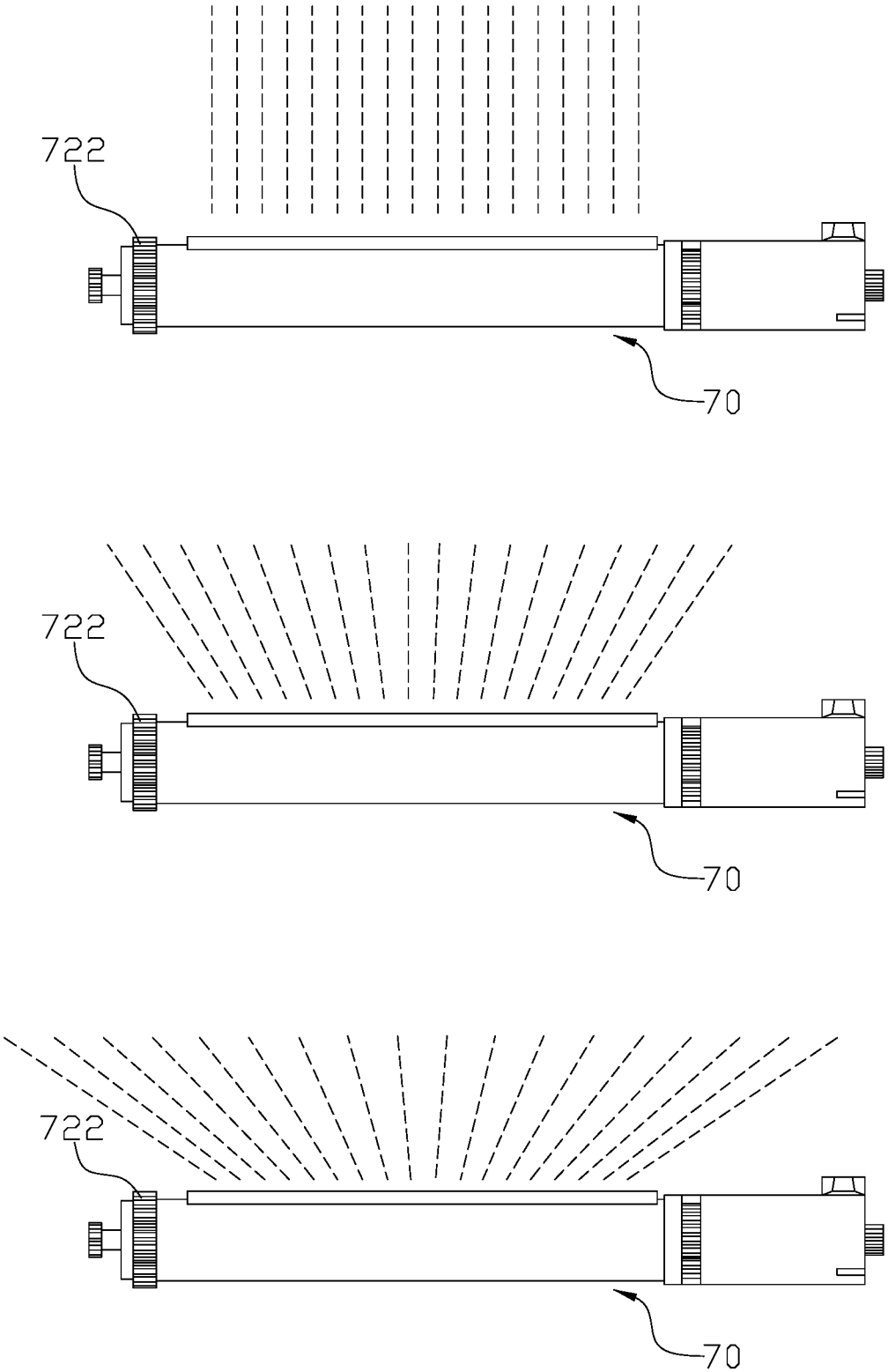
FIG. 14 is a drawing of a variation of the water flower when the another conventional structure is adjusted.

With the above structure, in actual use, when the knob 41 is rotated in the positive and negative directions, the engagement of the screw 42 and the screw hole 32 is used to drive the adjusting base 30 to generate relative back and forth displacement. In the transition process of the adjusting base 30, the different portions of the adjustment long hole 31 makes contact with the nozzle 22 which drives the nozzle 22 to swing in different angles, as shown in FIG. 5 and FIG. 6. The nozzle 22 can adjust the sprinkle area as a small concentered range or a fan-shaped diffusion range. Since the adjustment of the nozzle 22 is executed by the rotation of the driving member 40 in the middle part of the adjusting base 30 and can be completed quickly in a single operation, the adjusting base 30 is not force to titled, and it is more effortlessly and conveniently with more evenly water dense.

With the structure of the above specific embodiments, the following benefits can be obtained: 1. When the nozzle 22 needs to be adjusted, the knob 41 only needs to be rotated once to complete the operation, thereby achieving a more time-saving, labor-saving and convenient operation. 2. During the adjustment of the nozzle 22, only need to rotate the knob 41 one time, so the water spray can evenly spray water after adjustment. 3. The adjustment of the nozzle 22 is based on the rotation of the driving member 40 in the adjustment base 30, and can be completed quickly in a single operation, so the adjusting base 30 is not inclined to one side, which achieves a more even and labor-saving operation. 4. When the adjusting base 30 is moving, the nozzle 22, the adjustment of the nozzle 22 can be execute more accurately and the output is more even and dense.

Although the present invention has been explained in relation to its preferred embodiment, it is to be understood that many other possible modifications and variations can be made without departing from the spirit and scope of invention as hereinafter claimed.

What is claimed is:

1. A driving structure for a garden sprinkler comprising: a main body, a sprinkler unit, at least one adjusting base, and at least one driving member, wherein:

the main body has a main base and an upper cover corresponding to each other, the main base being hollow and having an assembly opening at an end configured to accept the sprinkler unit and for connection to a hose connector; the main base having a recess and a streaming surface, a plurality of first through apertures disposed on the streaming surface corresponding to a plurality of second through apertures with progressively longer lengths disposed on the upper cover; the recess accepting the adjusting base and forming an enclosure with the upper cover; at least one through hole disposed in a middle portion of the main body and defined by integrating the main base with the upper cover, the through hole provided with a positioning baffle;

the sprinkler unit having a plurality of nozzles connected by a connecting strip; wherein when the sprinkler unit is disposed in the main base through the assembly opening, each nozzle passes through the corresponding first through aperture and the second through aperture, and the connecting strip pushes against the streaming surface of the main base;

the adjusting base has a plurality of adjusting extended holes in a radial arrangement and a screw hole dispose at a middle portion; the adjusting base disposed on the recess between the main base and the upper cover, the screw hole aligned with the through hole, each nozzle passing through each corresponding adjusting extended hole and the second through aperture and protruding from the main body; and the driving member has a knob comprising a screw, a positioning groove disposed on the screw adjacent to the knob, the driving member disposed in the through hole and secured by the screw hole, and with the combination of the upper cover and the main base, the positioning baffle engages the positioning groove to cause the driving member to idle instead of escaping.

2. The driving structure for a garden sprinkler as claimed in claim 1, wherein the main base and the upper cover comprise a snap-fit connection.

3. The driving structure for a garden sprinkler as claimed in claim 1, wherein the nozzle further comprises an input end passing through the connecting strip and an output end passing through the first through aperture, the adjusting extended hole and the second through aperture, and the input end is larger than the output end.

4. The driving structure of a garden sprinkler as claimed in claim 1, wherein a neck portion is disposed on the nozzle and adjacent to the connecting strip, and the neck portion allows the first through aperture of the main base to engage with the sprinkler unit.

5. The driving structure of for a garden sprinkler as claimed in claim 1, wherein the nozzle is made of rubber or a flexible material.

6. The driving structure for a garden sprinkler as claimed in claim 1, wherein the adjusting base is a hollow housing and the assembly opening faces downwardly.

7. The driving structure for a garden sprinkler as claimed in claim 1, wherein the main body is configured for direct placement on the ground.

8. The driving structure for a garden sprinkler as claimed in claim 1, wherein the main body further comprises a bottom base allowing the main body to rotate on the bottom base while sprinkling water.

9. The driving structure for a garden sprinkler as claimed in claim 1, wherein a through hole is disposed in a middle portion of the main body, and the through hole accepts installation of the adjusting base and a driving member.

10. The driving structure for a garden sprinkler as claimed in claim 1, wherein two adjusting bases are disposed in the recess of the main body, the adjusting extended holes on the two adjusting bases are placed in a corresponding radial arrangement and respectively have a screw hole at a middle portion, and each screw hole is provided with a corresponding screw engaging with the driving member of the main body.

* * * * *